US009017182B1

(12) United States Patent
Freiler, Jr. et al.

(10) Patent No.: US 9,017,182 B1
(45) Date of Patent: Apr. 28, 2015

(54) GOLF TRAINING APPARATUS AND METHOD

(71) Applicants: Bruce Leon Freiler, Jr., Sparks, NV (US); James Augustus Zeigler, Sparks, NV (US)

(72) Inventors: Bruce Leon Freiler, Jr., Sparks, NV (US); James Augustus Zeigler, Sparks, NV (US)

(73) Assignees: Bruce Leon Freiler, Sparks, NV (US); James August Zeigler, Sparks, NV (US)

( * ) Notice: Subject to any disclaimer, the term of this patent is extended or adjusted under 35 U.S.C. 154(b) by 0 days.

(21) Appl. No.: 14/560,130

(22) Filed: Dec. 4, 2014

Related U.S. Application Data

(60) Provisional application No. 61/950,133, filed on Mar. 9, 2014.

(51) Int. Cl.
*A63B 69/36* (2006.01)

(52) U.S. Cl.
CPC ..... *A63B 69/3608* (2013.01); *A63B 69/3623* (2013.01)

(58) Field of Classification Search
USPC ..... 473/201, 205, 206, 207, 212, 213, 226, 473/227, 229, 276, 298, 551
See application file for complete search history.

(56) References Cited

U.S. PATENT DOCUMENTS

| | | | | | |
|---|---|---|---|---|---|
| 742,004 | A | * | 10/1903 | Carnegie | 473/205 |
| 1,536,211 | A | * | 5/1925 | Gregory | 473/206 |
| 2,476,489 | A | * | 7/1949 | Grandinetti | 473/205 |
| 3,554,554 | A | * | 1/1971 | Zane | 473/206 |
| 4,643,428 | A | | 2/1987 | Churchill | |
| 5,174,575 | A | | 12/1992 | Leith et al. | |
| 5,447,312 | A | | 9/1995 | Nixon et al. | |
| D372,064 | S | * | 7/1996 | del Barrio | D21/791 |
| 5,685,787 | A | | 11/1997 | Kogut | |
| 5,865,685 | A | | 2/1999 | Thomas | |
| 5,902,189 | A | | 5/1999 | Schultz | |
| 6,830,521 | B2 | * | 12/2004 | Socci | 473/458 |
| 6,863,616 | B2 | | 3/2005 | Snyder et al. | |
| 7,976,398 | B2 | | 7/2011 | Clawson | |
| 8,221,255 | B1 | * | 7/2012 | Wang | 473/213 |
| 2009/0156322 | A1 | * | 6/2009 | Luly et al. | 473/206 |

* cited by examiner

*Primary Examiner* — Nini Legesse
(74) *Attorney, Agent, or Firm* — Marc D. Foodman; Watson Rounds

(57) ABSTRACT

A golf training apparatus and method for maintaining proper position of a golfer's hands on the grip of a golf club during a swing. The apparatus is a strap assembly that wraps around the wrist of the upper hand and is secured to the shaft of the golf club just below the grip. A backswing loop secures the wrist to the top of the club grip. As the golfer swings the club, the apparatus maintains the hands in proper alignment resulting in proper swing mechanics that produce a straighter flight of the ball with reduced slice, draw or fade of the ball that may be imparted to the ball due to undesirable spin occurring throughout either the golfer's entire swing or a portion or thereof.

20 Claims, 8 Drawing Sheets

GOLF TRAINING APPARATUS AND METHOD

RELATED APPLICATION INFORMATION

This application claims priority benefit from U.S. Provisional Application Ser. No. 61/950,133, filed on Mar. 9, 2014, the entirety of which is incorporated by reference in the present application.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

The present invention relates generally to golf training devices and methods of use, and more particularly, to a golf training aid for keeping a golfer's hands in the proper position on the club handle during a swing.

Golf is a difficult game that requires extensive practice for a player to develop a consistent swing that produces proper ball flight without undesirable slice, draw or fade action on the ball. To master a consistent swing, the golfer's hands must grip the club to impart the proper motion as the club is brought back for the backswing and then as it is brought through the sweeping motion as it comes down, connects with the ball and continues into the follow through. At each phase of the swing, it is important that the golfer's hands maintain proper position on the grip. Golf training aids are known and have been used to help train a golfer to maintain proper grip. While such prior art aids have been useful for setting the golfer's hands in position, none have provided the proper grip through connection to the club at points both above and below the hands to securely maintain proper golf grip throughout all phases of the golf swing.

The present invention is a flexible strap assembly with one end that removably attaches to the club at a point below the grip. The strap other end of the strap assembly is secured around the wrist of the golfer and is adjustable to fit snugly. A backswing control strap is attached to the wrist portion and then wraps around the end of the grip of the club and is then secured to the wrist portion. The design of the assembly helps a golfer to improve swing mechanics by providing muscle memory in the golfer's arms and hands as the golfer swings through the impact position.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION

Figure 1:
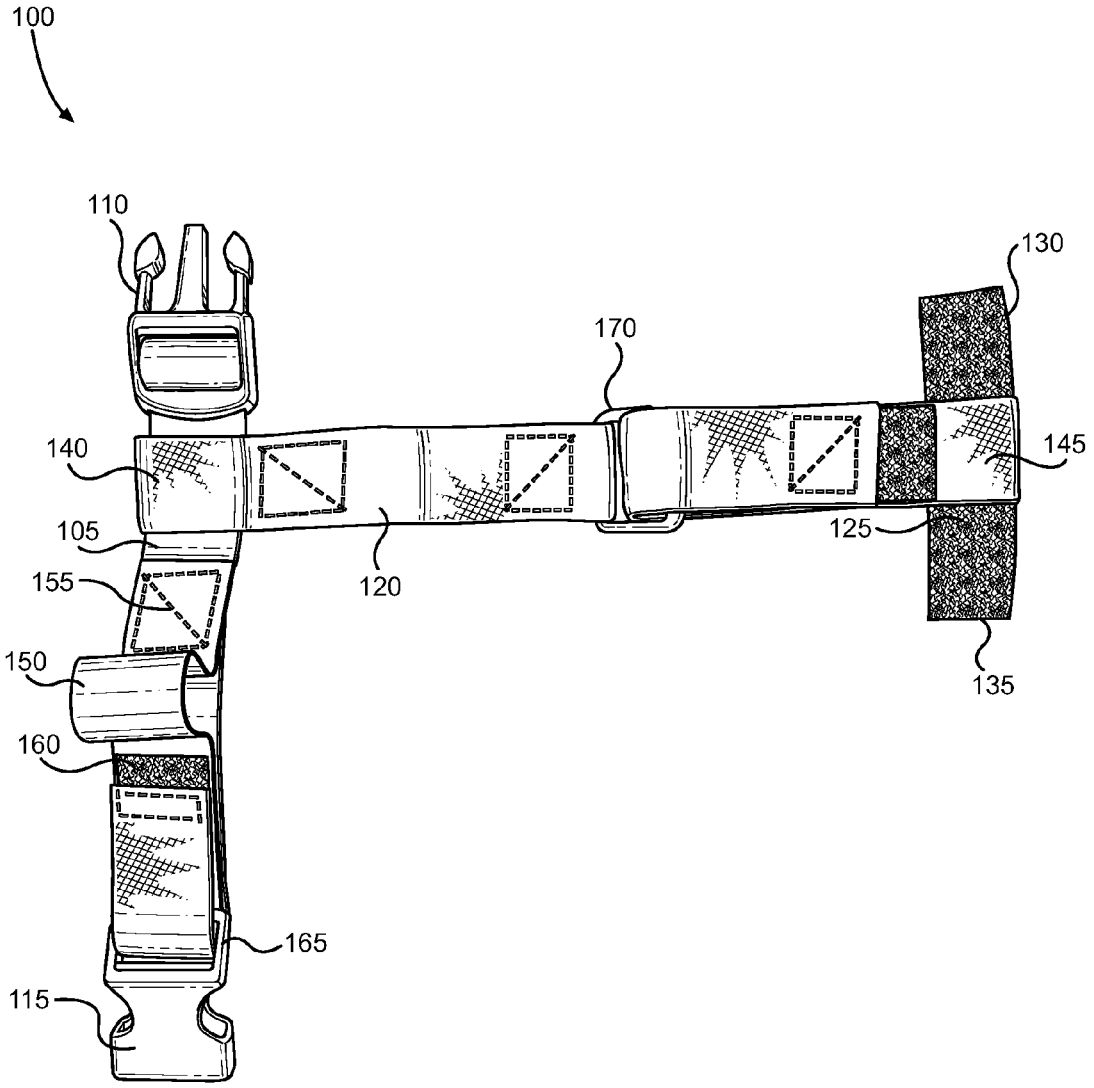
FIG. 1 shows a golf training aid strap assembly of the present invention.

The present invention will now be described more fully with reference to the accompanying drawings. It should be understood that the invention may be embodied in many different forms and should not be construed as limited to the embodiments set forth herein. Throughout FIGS. 1-8, like elements of the invention are referred to by the same reference numerals for consistency purposes.

The present invention is a golf training apparatus and method for maintaining proper position of a golfer's hands on the grip of a golf club during a swing. The apparatus is a strap assembly that wraps around the wrist of the upper hand and is secured to the shaft of the golf club just below the grip. A backswing control loop secures the wrist to the top of the club grip. As the golfer swings the club, the apparatus maintains the hands in proper alignment resulting in proper swing mechanics that produce a straighter flight of the ball with reduced slice, draw or fade of the ball due to imparting undesirable spin to the ball throughout the entire swing motion.

FIG. 1 shows strap assembly 100 of the present invention. A wrist strap portion 105 wraps around the wrist of the golfer and is adjustable for different sized wrists. A first end 110 of the wrist strap portion includes an attachment device, which may be for example, a first side of an attachment mechanism such as a plastic buckle, a snap, or the hook side of a hook and loop fastener such as Velcro® brand hook and loop fastener. Wrist strap portion 105 is intended to be wrapped around the wrist of the golfer's top hand on the golf club grip at the top of the golf club shaft. A second end 115 of wrist strap portion 105 includes the receiving side of the attachment device, which may for example, be a plastic buckle, snap or the loop side of the hook and loop fastener. When the first end 110 and second end 115 are brought together they are coupled to each other for a secure, but detachable or removable coupling. It should be understood that other types of coupling devices may be used in place of the plastic buckle or clasp assembly.

A club attachment strap 120 is joined to wrist strap 105 at approximately a 90 degree angle at an area between first end 110 and second end 115 of wrist strap 105. A club securing strap 125 is joined to club attachment strap 120 and is configured to wrap around the shaft of the golf club just below the golf club grip. In a configuration similar to wrist strap 105, club securing strap 125 has a first end 130 with an attachment device and a second end 135 with an opposing attachment device (e.g. hook and loop fasteners or a plastic buckle or clasp) to removably couple the two ends together once club securing strap 125 is wrapped around the shaft of the golf club just below the club grip.

Club attachment strap 120 is joined to wrist strap 105 by forming a loop 140 in strap 120 through which strap 105 passes or simply stitching the two straps together at an overlap area where loop 140 is shown. Similarly, club attachment strap 120 is attached to club securing strap 125 by forming a loop 145 through which strap 125 passes or simply stitching the two straps together at an overlap area where loop 145 is shown.

Backswing control loop 150 is formed on wrist strap 105 by affixing a separate piece of material that is a backswing control loop to strap 105 with loop 150 secured to wrist strap 105 at areas 155, 160. Backswing control loop 150 is fitted over the top of the grip of the golf club during use.

The straps (wrist strap 105, club attachment strap 120 and club securing strap 125) described that make up strap assembly 100 are preferrably made of flexible strap material, such as for example, woven nylon, polyester, cotton or any other material that is suitable for the intended purpose. The material should be durable and easily washable. The material may also include elastic material to allow it to be stretched to fit around the golfer's wrist as well as around the golf club shaft and grip where required. The approximate dimensions of the various components of strap assembly 100 are as follows: (a) wrist strap 105—11.5 inches long by 1.0 inch wide; (b) club attachment strap 120 may be formed of two sections—each is 9.0 inches long by 1.0 inch wide; (c) club securing strap 125—4.0 inches long by 1.0 inches wide; and (d) backswing control loop 150—5.25 inches long by 1.0 inch wide. Backswing control loop 150 is affixed to wrist strap 105 in overlap areas 155, 160 that are approximately 1.0 square inch each to form a loop of approximately 3.25 inches that wraps around the top of club grip 215.

It should be understood that any one or more of the different strap components may be made adjustable. For example, an end of wrist strap 105 may be looped through a pass through section 165 of buckle component 115 and removably affixed back to itself using hook and loop fastener areas on a portion of strap 105, or by forming two portions of a strap and using a plastic connector 170 as is shown for strap 120 where an end of one portion is affixed back to the strap itself using hook and loop fastener areas on a portion of strap 120. Alternatively, the particular dimensions of the straps may be manufactured in different sizes without affecting the functionality of strap assembly 100. For example, strap assembly 100 may be shorter and narrower for use by a woman or a child compared to that of a man.

Figure 2:
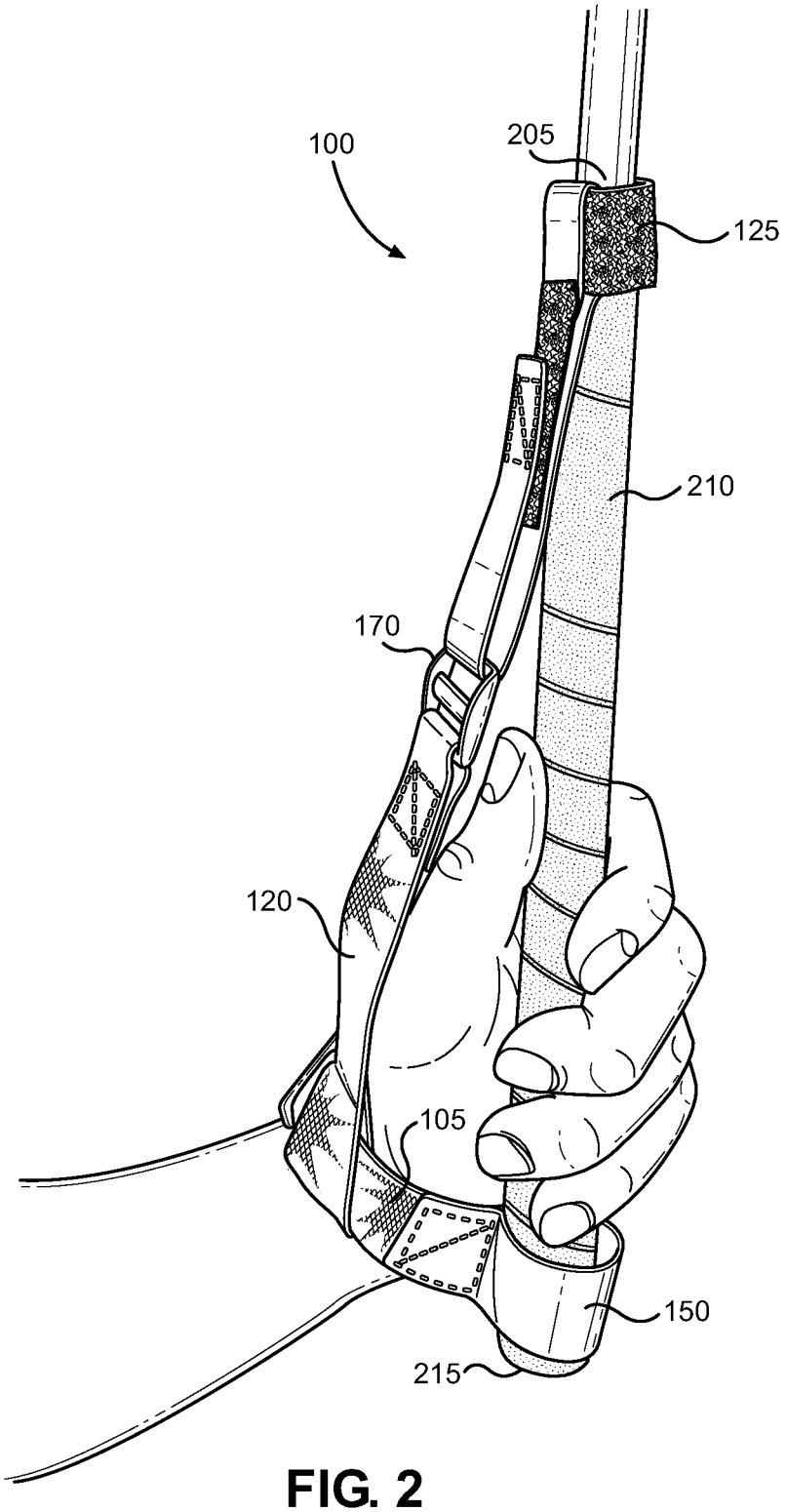
FIG. 2 shows a first view of the strap assembly in place around the wrist of a golfer's upper hand and attached to the golf club shaft below the grip.

FIGS. 2-10 shows various views of strap assembly 100 in use. FIG. 2 shows a first view of strap assembly 100 in place around the wrist of a golfer's upper hand and attached to an area 205 of a golf club 210 below a golf club grip. This view is shown towards the inside of the golfer's palm orientation. As can be seen, wrist strap 105 is secured snugly around the golfer's wrist. Club attachment strap 120 extends from wrist strap 105 to the bottom of club grip. Club securing strap 125 is shown attached to the end of club attachment strap 120 and is wrapped around and secured to club 210 at area 205 below the grip. Backswing control strap 150 is shown around the top of club grip 215.

Figure 3:
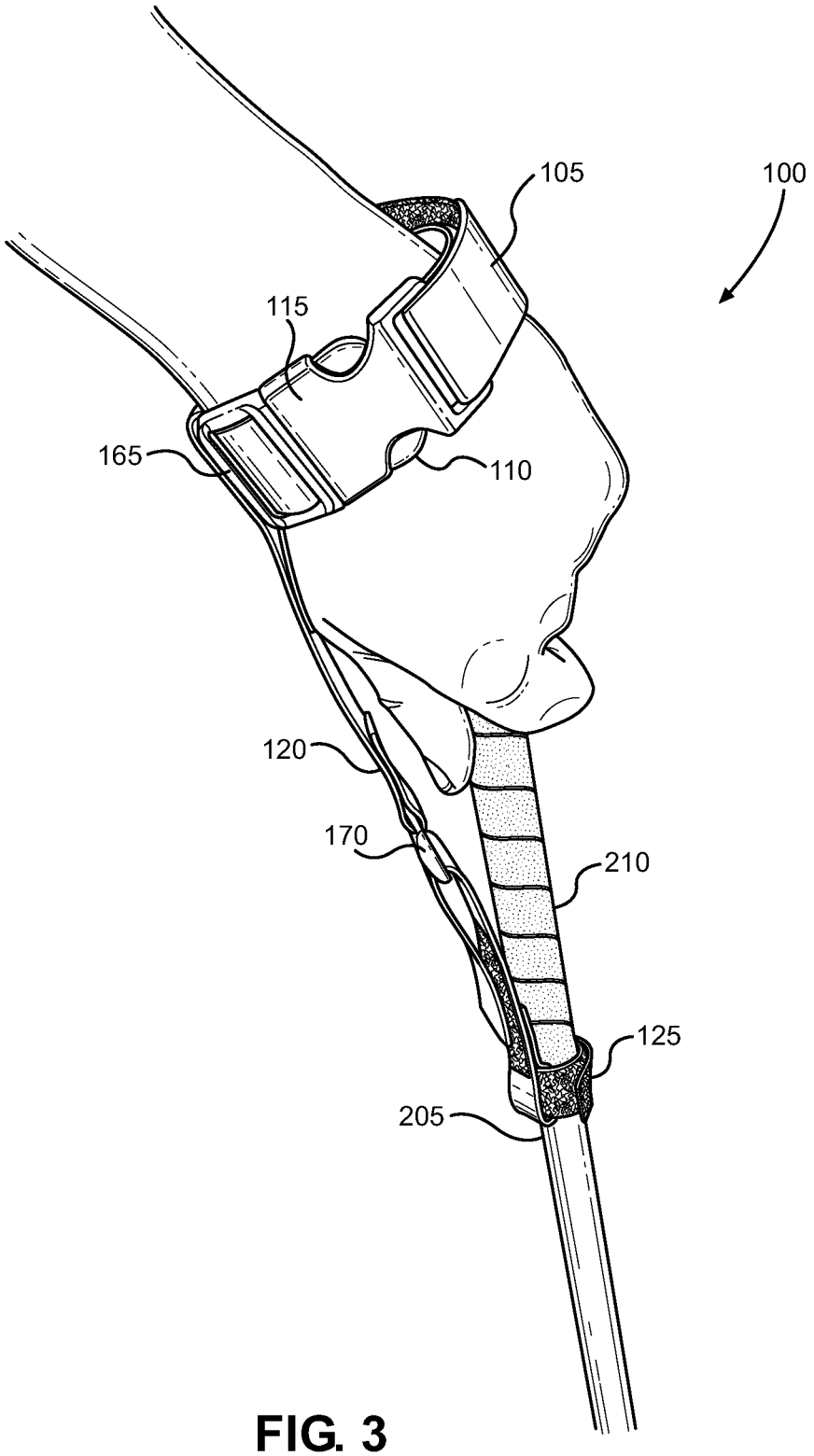
FIG. 3 shows a second view of the strap assembly in place around the wrist of a golfer's upper hand and attached to the golf club shaft below the grip and at the top of the grip.

FIG. 3 shows a view of strap assembly 100 in place around the wrist of the golfer's upper hand and attached to area 205 of golf club 210 below the golf club grip (as in FIG. 2) from the orientation of the back of the hand.

Figure 4:
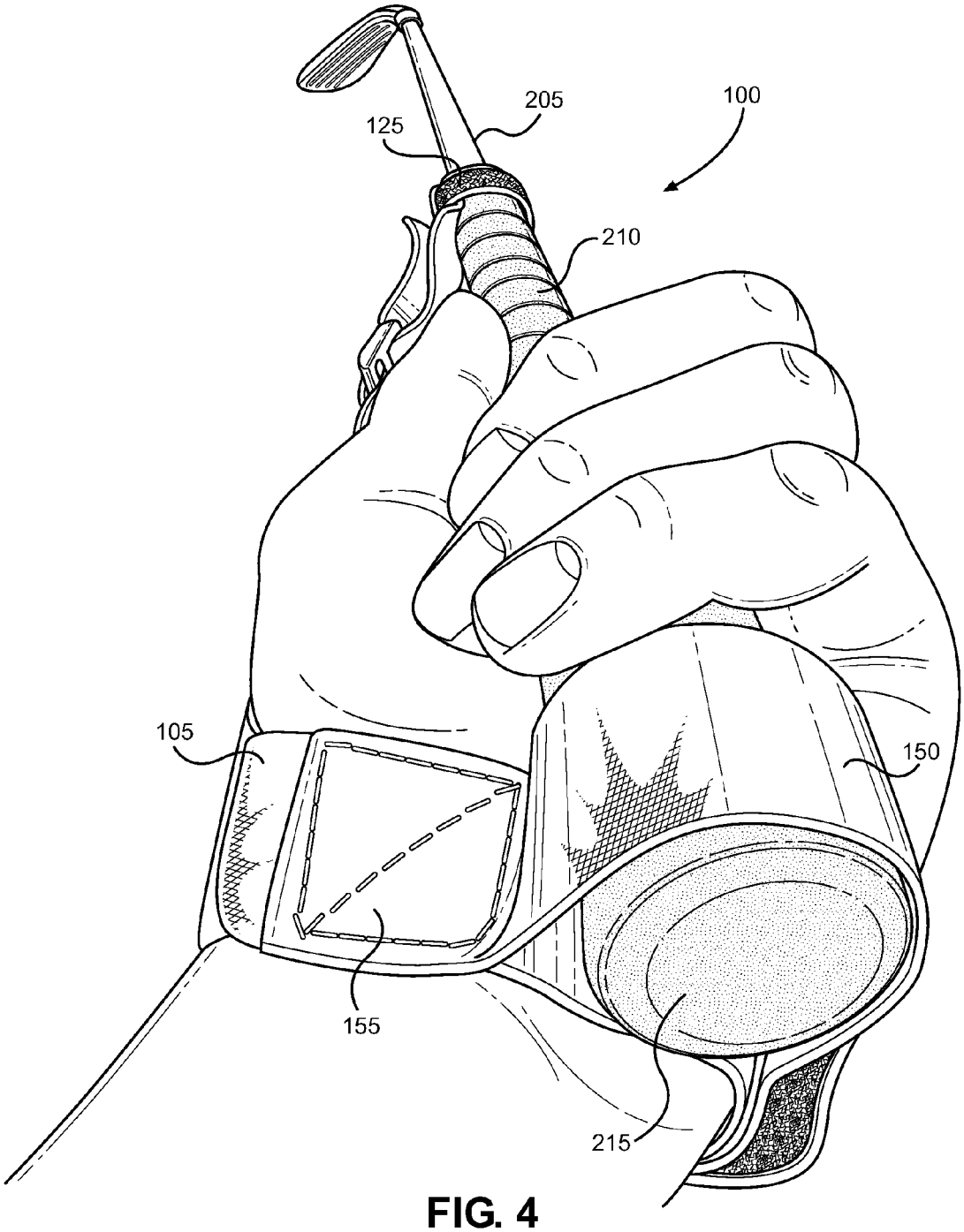
FIG. 4 shows a third view of the strap assembly in place around the wrist of a golfer's upper hand and attached to the golf club shaft below the grip and at the top of the grip.

FIG. 4 shows a top down view of golf club 210 from the top of grip 215. Strap assembly 100 is in place around the wrist of the golfer's upper hand and attached to area 205 of a golf club 210 below the golf club grip (as in FIGS. 2-3). In FIG. 4, backswing control loop 150 is shown around the top of club grip 215 with overlap area 155 shown affixed by stitching to wrist strap 105.

Figure 5:
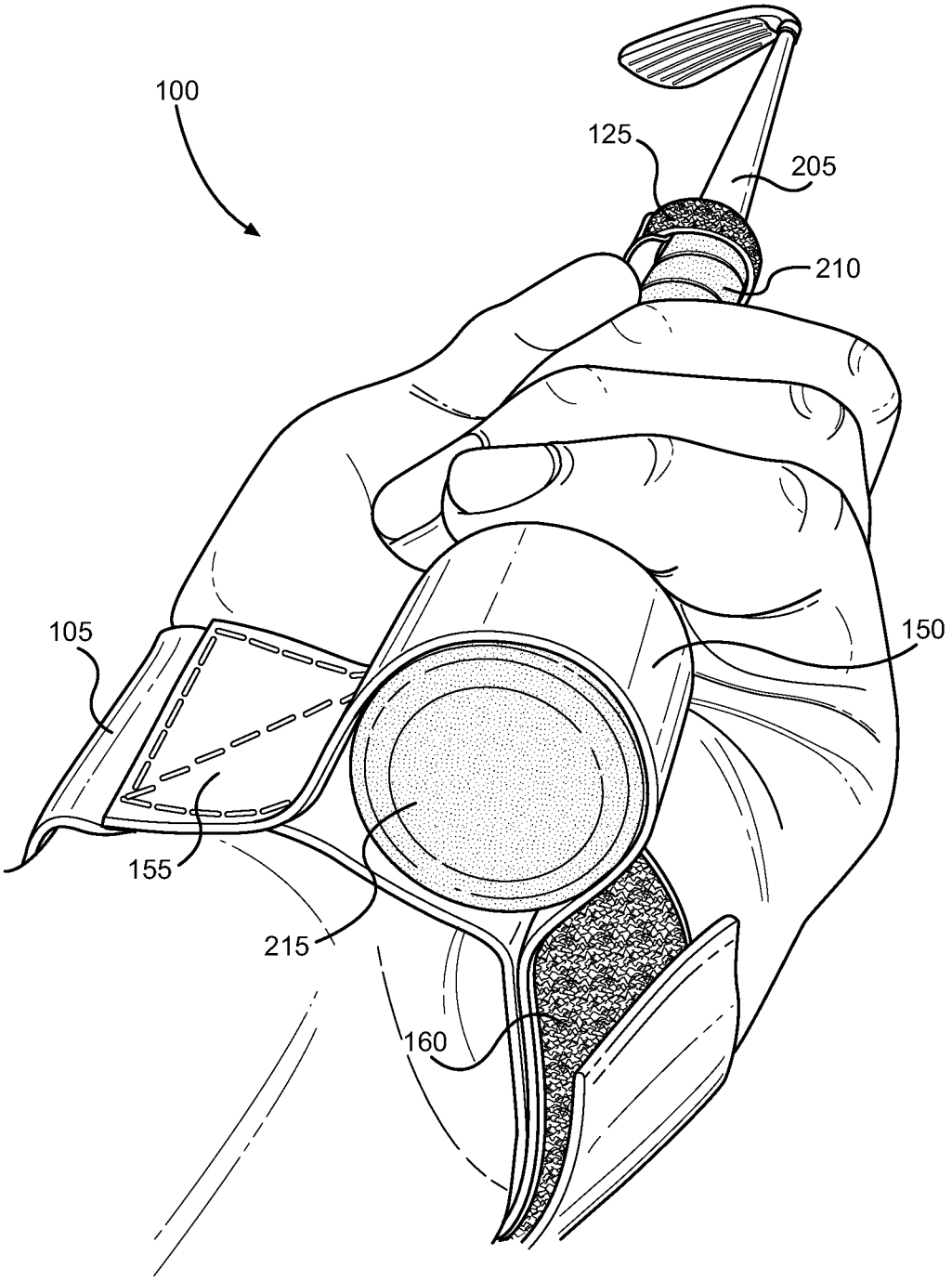
FIG. 5 shows a fourth view of the strap assembly in place around the wrist of a golfer's upper hand and attached to the golf club shaft below the grip and at the top of the grip.

FIG. 5 shows a different top down view of golf club 210 from top of grip 215. Strap assembly 100 is in place around the wrist of the golfer's upper hand and attached to area 205 of a golf club 210 below the golf club grip as in FIGS. 2-4. In FIG. 5, backswing control loop 150 is wrapped around the top of club grip 215. In this view, overlap area 155 of control loop 150 is shown affixed to wrist strap 105 by stitching while the stitching in overlap area 160 is covered by an attachment area to which the end of strap 105 is attached. Club securing strap 125 is removably wrapped around the shaft of club 210 below the grip.

Figure 6:
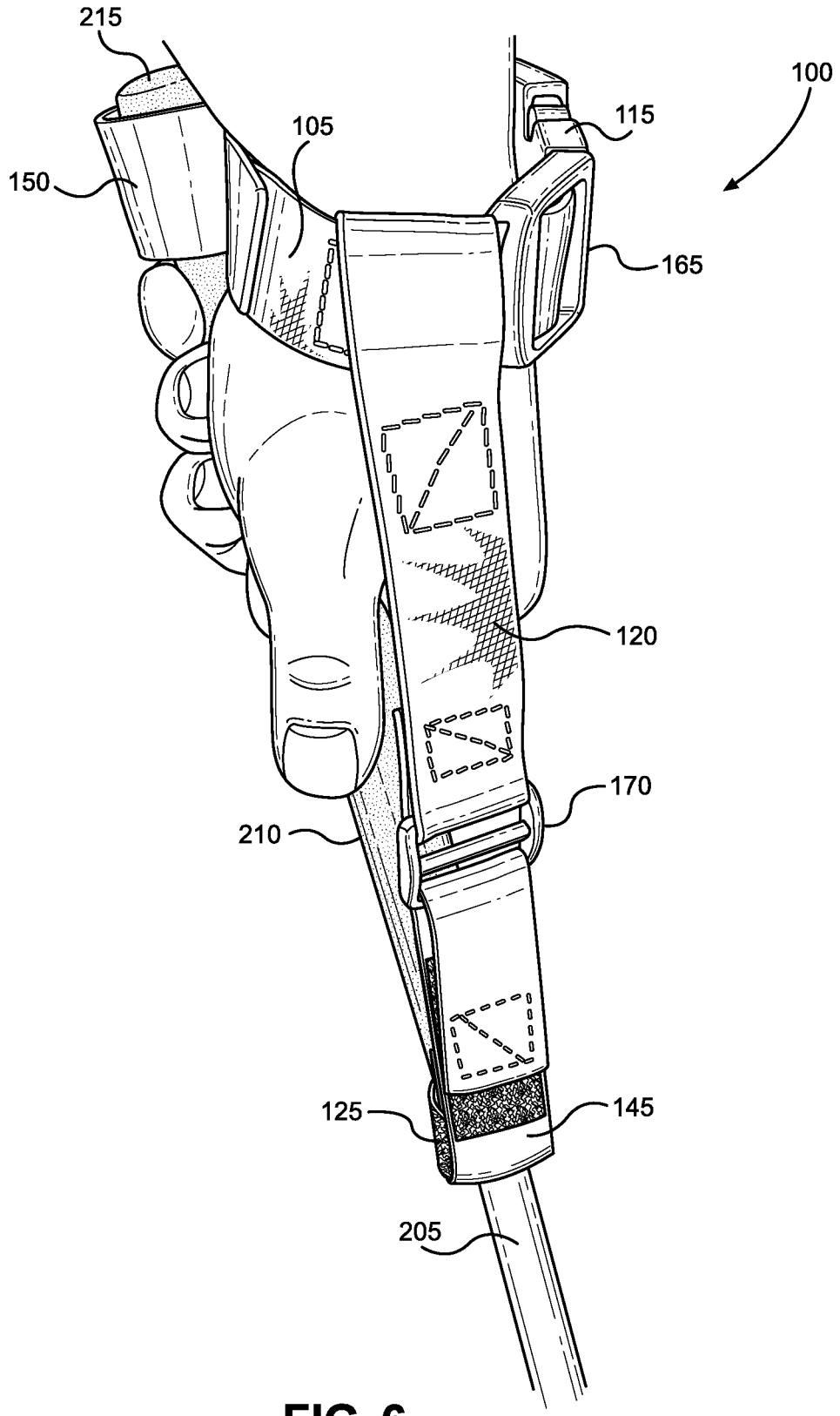
FIG. 6 shows a fifth view of the strap assembly in place around the wrist of a golfer's upper hand and attached to the golf club shaft below the grip and at the top of the grip.

FIG. 6 shows an opposing side view of golf club 210 from FIG. 2. Strap assembly 100 is worn by a golfer with wrist strap 105 in place around the wrist of the golfer's upper hand. Club attachment strap 120 extends from wrist strap 105 to the bottom of the club grip. Club securing strap 125 is shown attached to the end of club attachment strap 120 and is wrapped around and secured to club shaft 210 at area 205 below the grip. Backswing control strap 150 is shown around the top of club grip 215 and is attached to area 205 of the shaft of a golf club 210 below the golf club grip as in FIGS. 2-5. In FIG. 6, backswing control loop 150 is removably wrapped around the top of club grip 215.

Figure 7:
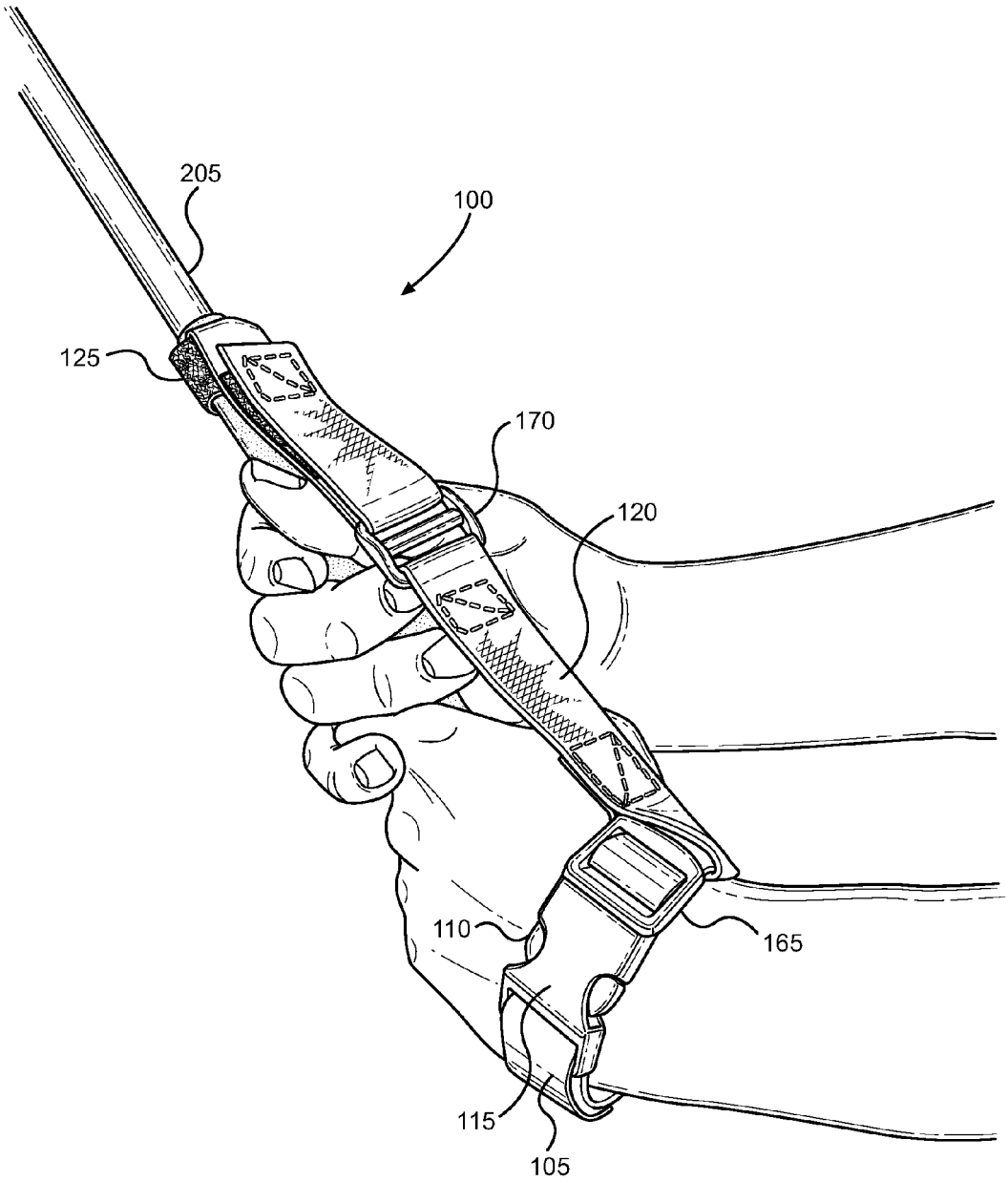
FIG. 7 shows a sixth view of the strap assembly in place around the wrist of a golfer's upper hand with both hands on the club where the strap assembly is attached to the golf club shaft below the grip and at the top of the grip.

FIG. 7 shows a side view of golf club 210 with both of the hands of a golfer in a typical grip position on the club grip of golf club 210. Strap assembly 100 is in place around the wrist of the golfer's upper hand and attached to area 205 of golf club 210 below the golf club grip as in FIGS. 2-6. In FIG. 7, backswing control loop 150 (not visible) has been removably wrapped around the top of club grip 215. Club attachment strap 120 can be seen over the thumb of the golfer's lower hand and extending from wrist strap 105 to club securing strap 125.

Figure 8:
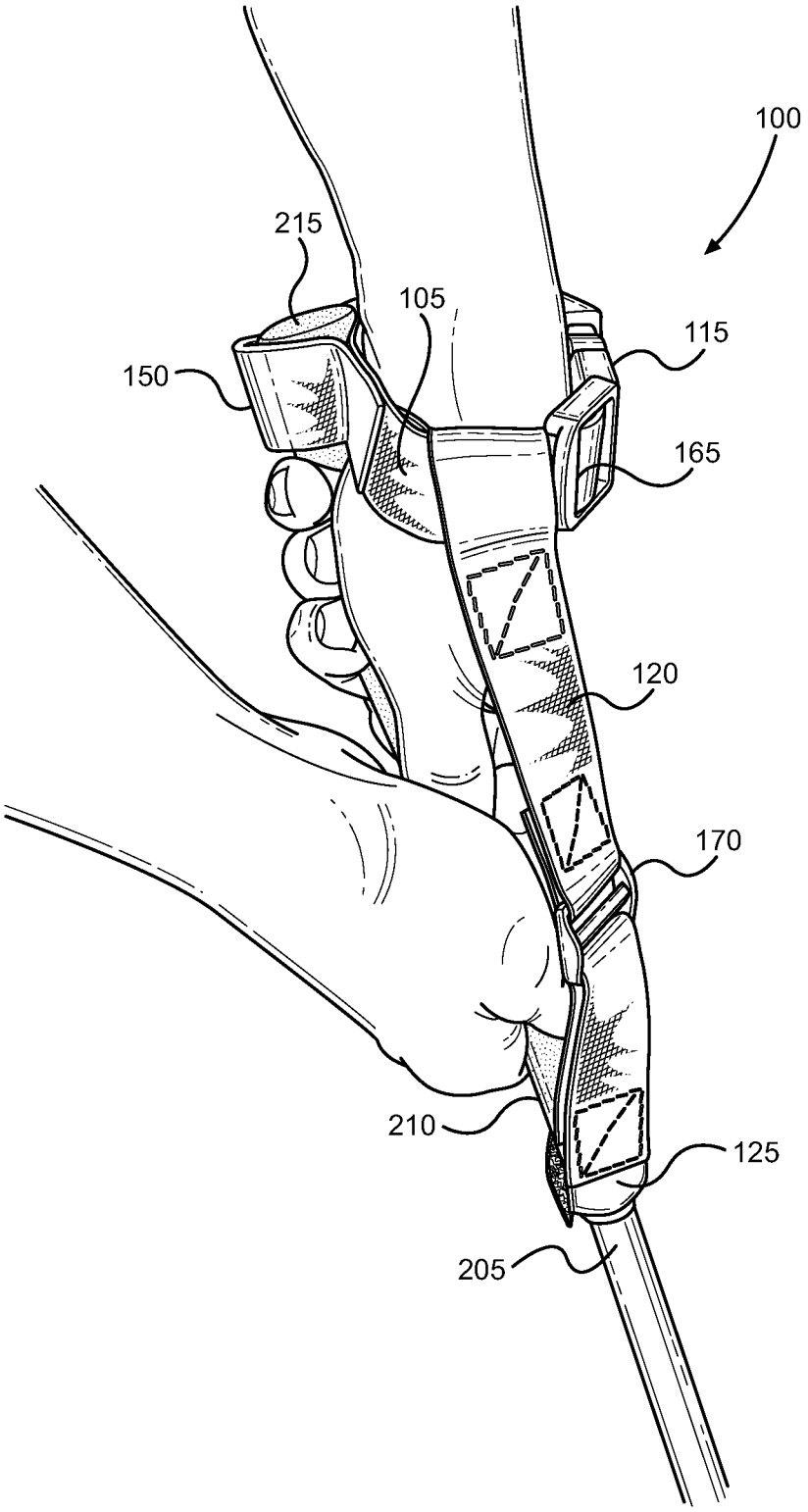
FIG. 8 shows a seventh view of the strap assembly in place around the wrist of a golfer's upper hand with both hands on the club where the strap assembly is attached to the golf club shaft below the grip and at the top of the grip.

FIG. 8 shows a perspective view of golf club 210 with both of the golfer's hands on the club. Strap assembly 100 is in place around the wrist of the golfer's upper hand and attached to area 205 of a golf club 210 below the golf club grip as in FIGS. 2-7. In FIG. 8, backswing control loop 150 is removably wrapped around the top of club grip 215. Club attachment strap 120 can be seen over the thumb of the golfer's lower hand and extending from wrist strap 105 to club securing strap 125.

In operation and during all phases of a golfer's swing, strap assembly 100 maintains the golfer's hands in proper position. As the player repeats the swing over and over again using strap assembly 100, the player develops a familiarity or "muscle memory" with proper hand position on the grip and is able to repeat it consistently even when strap assembly 100 is removed for competitive play.

In particular, strap assembly 100 provides muscle memory with respect to the golfer's arms and hands when the golfer is in the position of impacting the ball and at other phases of the swing. The club face is squared into position to deliver the sweet spot of the club to the ball to effectively provide distance and accuracy. With strap assembly 100 in place such that wrist strap 105 is around the golfer's wrist and club securing strap 125 is attached to golf club 210 below the grip at area 205, along with the fitting of backswing control strap 150 removably wrapped around the top end of club grip 215, this configuration places the head of the golf club into a firm and effective area allowing the golfer to consistently complete the downswing through the ball with the sweet spot of the club directly contacting the ball. Strap assembly 100 maintains the golfer's top or leading arm on the correct swing plane and helps lock the leading elbow giving the golfer the ability to keep a consistent swing arc to enable an accurate and solid strike to the ball. In addition, as the downswing is completed and into the follow through, backswing control loop 150 firmly supports the golfer's upper hand, providing complete muscle memory control in the golfer's arms and hands through take away (backswing), forward motion and follow through. The tautness of backswing control loop 150 tightens to some extent as the club reaches parallel position in the backswing and completely tightens at the top of the backswing. This creates the proper wrist cocking action to give the golfer the ability to bring the desired whipping action and the lag that powers the ball at impact for maximum distance on the flight of the ball.

It is to be understood that the above descriptions and drawings are only for illustrating representative variations of the present invention and are not intended to limit the scope thereof. Any variation and derivation from the above description and drawings are included in the scope of the present invention.

What is claimed is:

1. A golf training apparatus comprising:

a wrist strap having a first end and a second end removably coupled to each other when the wrist strap is wrapped around the wrist of a golfer;

a club attachment strap having a first end joined to a section of the wrist strap and a second end;

a club securing strap joined to the second end of the club attachment strap and having a first end and a second end removably coupled to each other when the club securing strap is wrapped around the shaft of a golf club; and a backswing control loop joined to a section of the wrist strap and removably wrapped around an upper portion of the golf club.

2. The apparatus of claim 1 further comprising a first buckle component affixed to the first end of the wrist strap and a second buckle component affixed to the second end of the wrist strap wherein the first buckle component removably couples to the second buckle component.

3. The apparatus of claim 2 wherein at least one of the first buckle component and the second buckle components includes a pass through section through which an end of the wrist strap passes such that it is looped back and adjustably joined to a portion of the length of the wrist strap.

4. The apparatus of claim 1 further comprising hook fasteners on either the first end or the second end of the club securing strap and loop fasteners on the other of the first end or the second end of the club securing strap wherein the first end and the second end are removably coupled together when the club securing strap is wrapped around the golf club.

5. The apparatus of claim 1 wherein at least one of the straps further comprises an adjustment component wherein the at least one strap is formed in two sections, the two sections being joined together by the adjustment component.

6. The apparatus of claim 1 wherein at least one of the straps is made of a woven, flexible material.

7. The apparatus of claim 1 further comprising a loop in the first end of the club adjustment strap that is joined to the wrist strap such that the loop slides along a portion of the wrist strap to a position selected by a user.

8. The apparatus of claim 1 wherein the backswing control loop is joined to the wrist strap at a first overlap area and a second overlap area along a length of the wrist strap.

9. The apparatus of claim 8 wherein the backswing control loop and the wrist strap are permanently joined at least one of the first overlap area or the second overlap area.

10. The apparatus of claim 8 wherein the backswing control loop and the wrist strap are temporarily joined at least one of the first overlap area or the second overlap area.

11. A method of using a golf training apparatus comprising:

securing a wrist strap to a golfer's wrist wherein the wrist strap has a first end and a second end removably coupled to each other when the wrist strap is wrapped around the wrist of a golfer;

providing a club attachment strap having a first end joined to a first section of the wrist strap and a second end;

providing a club securing strap joined to the second end of the club attachment strap wherein the club securing strap has a first end and a second end removably coupled to each other when the club securing strap is wrapped around a golf club shaft;

removably joining the club securing strap to a golf club shaft at a position below a golf club grip;

providing a backswing control loop joined to the wrist strap; and positioning the backswing control loop around a top portion of the golf club grip.

12. The method of claim 11 wherein a first buckle component is affixed to the first end of the wrist strap and a second buckle component is affixed to the second end of the wrist strap such that the first buckle component removably couples to the second buckle component.

13. The method of claim 12 wherein at least one of the first buckle component and the second buckle components includes a pass through section through which an end of the wrist strap passes such that it is looped back and adjustably joined to a portion of the length of the wrist strap.

14. The method of claim 11 wherein hook fasteners are positioned on either the first end or the second end of the club securing strap and loop fasteners on the other of the first end or the second end of the club securing strap to be removably coupled together when the club securing strap is wrapped around the golf club.

15. The method of claim 11 wherein at least one of the straps further comprises an adjustment component wherein the at least one strap is formed in two sections, the two sections being joined together by the adjustment component.

16. The method of claim 11 wherein at least one of the straps is made of a woven, flexible material.

17. The method of claim 11 wherein a loop in the first end of the club adjustment strap is joined to the wrist strap such that the loop slides along a portion of the wrist strap to a position selected by a user.

18. The method of claim 11 wherein the backswing control loop is joined to the wrist strap at a first overlap area and a second overlap area along a length of the wrist strap.

19. The method of claim 18 wherein the backswing control loop and the wrist strap are permanently joined at least one of the first overlap area or the second overlap area.

20. The method of claim 18 wherein the backswing control loop and the wrist strap are temporarily joined at least one of the first overlap area or the second overlap area.

* * * * *